US005901819A

United States Patent [19]

Engle

[11] Patent Number: 5,901,819

[45] Date of Patent: May 11, 1999

[54] TREAD-DISC ASSIST DUAL TRUCK MOUNTED BRAKE ASSEMBLY

[75] Inventor: Thomas H. Engle, Clayton, N.Y.

[73] Assignee: Westinghouse Air Brake Company, Wilmerding, Pa.

[21] Appl. No.: 08/748,199

[22] Filed: Nov. 12, 1996

[51] Int. Cl.[6] ..... B61H 13/00

[52] U.S. Cl. ..... 188/219.1; 188/225.6

[58] Field of Search ..... 188/219.1, 219.6, 188/222.6, 225.6

[56] References Cited

U.S. PATENT DOCUMENTS

| | | | |
|---|---|---|---|
| 2,886,146 | 5/1959 | Klasing, Jr. | 188/219.1 |
| 2,958,397 | 11/1960 | Newell | 188/219.1 |
| 5,000,298 | 3/1991 | Jackson et al. | 188/219.1 |
| 5,361,876 | 11/1994 | Haverick et al. | 188/219.1 |

*Primary Examiner*—Matthew C. Graham
*Attorney, Agent, or Firm*—James Ray & Associates

[57] ABSTRACT

Brake system for retarding rotating machinery. It has an actuator with a first portion and a second portion. Actuator is supplied with energy and generates force causing relative motion of the first and second portions. The second portion is connected to an actuator lever and the first portion is connected to a brakebeam. The lever has a second pivot connection also connected to the brakebeam and it has a third pivot connection attached to a reaction device. The reaction device is connected to an equalizer lever which is connected to a second brakebeam and a second reaction device. The second reaction device is connected back to the first brakebeam, or to the first portion of the actuator. The brakebeams each have three pivot connections at each end. Two are about parallel to the brakebeam and one is perpendicular. A pair of brake hangers are pivotally attached to the two parallel pivot connections and a proportionalization lever is pivotally attached to the vertical pivot connection. It receives force from the brakebeam and conveys the force to a force delivery mechanism at each of its ends. Each brake hanger has a force receiving mechanism to receive force from the force delivery mechanism at the ends of the proportionalization lever and each brake hanger has a brake shoe for forcible application to the rotating machinery to retard the rotating machinery.

20 Claims, 6 Drawing Sheets

TREAD-DISC ASSIST DUAL TRUCK MOUNTED BRAKE ASSEMBLY

CROSS REFERENCE TO RELATED APPLICATIONS

The invention taught in this patent application is closely related to the inventions taught in the following patent applications: Offset Arrangement for Brake System, Proportionalization Lever, U.S. Ser. No. 08/748,241, now U.S. Pat. No. 5,806,634 Cooling Spoke Arrangement For A Brake Disc, U.S. Ser. No. 08/745,429 now U.S. Pat. No. 5,826,685, Wedge-Shaped Disc Brake and Shoe, U.S. Ser. No. 08/748,200. The referenced patent applications were filed concurrently with the present application on Nov. 12, 1996 and have been assigned to the assignee of the present invention. The teachings of the referenced patent applications are incorporated into the present application by reference thereto.

FIELD OF THE INVENTION

The present invention relates, in general, to a brake system for retardation of rotating machinery and, more particularly, the invention relates to a tread-disc assist brake system for railway vehicles.

BACKGROUND OF THE INVENTION

The art of railway brakes includes two methods of retarding a railroad vehicle. One method is dynamic braking, in which the propulsion motors of a diesel-electric locomotive are used to generate electricity which is then dissipated through resistors. Another method is friction braking in which brake shoes are pressed against the treads of the wheels of the railroad vehicle, to provide a friction force which retards the wheels. Friction braking may also be provided by attaching a disc to a wheel or to an axle of the vehicle, and pressing brake shoes against the disc, thereby providing a friction force which retards the disc and hence retards the wheels. For friction braking in which brake shoes are applied to the wheels, heat is absorbed by the thermal mass of the wheels and then dissipated to the environment by conduction, convection and radiation from the wheels. For friction braking in which brake shoes are applied to discs, heat is absorbed by the thermal mass of the brake discs and then dissipated to the environment by conduction, convection and radiation from the discs.

In both cases, the amount of energy which can be absorbed is limited by the temperatures generated, since high temperatures may damage the brake shoes, or cause thermal stresses which cause warping or cracking of the wheels or brake discs. In some systems, the two methods are combined so that some of the heat is absorbed by the wheels and some is absorbed by the discs. By combining the two methods, more heat can be absorbed than can be absorbed by either method separately.

Such systems generally employ lever arrangements in which a single actuator, such as a brake cylinder, applies equal or proportional forces to a number of brake shoes, some of which may be applied to wheels, and some of which may be applied to discs which rotate with the wheels. Such systems may connect a single brake cylinder to brake shoes applied to all four wheels on a pair of axles. The lever arrangement which is typically used may apply equal force to the brake shoes on all four wheels.

Likewise, if each wheel has a disc associated with it, the lever arrangement may apply equal forces to brake shoes applied to all four discs. In some of these systems, brake shoes are applied to the rims of the brake discs. In others, brake shoes are applied to the faces of the discs. Application to the rim has an advantage over application to the face because the radius at which the friction force is generated is greater when it is applied to the rim than when it is applied to the face. Hence, the retarding torque exerted on the brake disc is greater when the shoe is applied with a given force to the rim than when the shoe is applied with the same force to the face.

For a railway vehicle, it is particularly important to apply the brake shoe at as great a radius as possible because the radius of the disc is limited by the required track clearance. In the United States this is 2.75 inches, so the radius of the brake disc must be at least 2.75 inches less than the radius of the wheel tread.

It is generally desirable for a brake system to provide a system for applying pressure to the brake shoe which provides mechanical advantage to amplify the total normal force between the brake shoe and the surface being retarded. For a brake shoe applied to the rim of a brake disc, prior attempts to accomplish this have been made by having the braking surface of the brake shoe have the form of a wedge, which is applied to a groove on the rim of the brake disc. With this configuration, the total normal force between the brake shoe and the brake disc is greater than the inward radial force applied to the shoe. An example of this is provided by U.S. Pat. No. 2,422,004.

SUMMARY OF THE INVENTION

The present invention provides a brake system for retarding one or more rotating members. The system has an actuator means such as a brake cylinder or solenoid which has a first portion and a second portion, the actuator generating a force causing relative motion of the first portion and the second portion. The actuator has means for connection to an energy source such as a pressurized fluid, or electricity.

The system has an actuator means lever which has three pivot connections. The second portion of the actuator is connected to one of these pivot connections. The system has a pair of brakebeams, one of which is connected to a second pivot connection of the actuator means lever. The first portion of the actuator is connected to this brakebeam.

The third pivot connection of the actuator means lever is connected to a reaction means which is connected to a pivot connection on an equalizer lever. The equalizer lever has three pivot connections, the second of which is connected to the second brakebeam. The third pivot connection of the equalizer lever is connected to a second reaction means, which is connected either to the first brakebeam or to the first portion of the actuator.

Each brakebeam has three pivot connections at each end. Of the three connections at each end, the first and second are for pivotal rotation about axes approximately parallel to the longest dimension of the brakebeam and the third is for pivotal rotation about an axis which is approximately perpendicular to the longest dimension of the brakebeam.

A proportionalization lever is pivotally connected to the third pivot connection of the brakebeam. It receives force from the brakebeam, and delivers the force to force delivery means at its ends.

One brake hanger is pivotally attached to the first of the three pivot connections of the end portion of the brakebeam and a second brake hanger is pivotally attached to the second of the three pivot connections of the end portion of the brakebeam. Each brake hanger has means to receive force from the force delivery means at either end of the proportionalization lever.

Each brake hanger has a brake shoe for forcible application to the rotating member to retard the rotating member.

OBJECTS OF THE INVENTION

It is, therefore, one of the primary objects of the present invention to provide apparatus for amplifying the force supplied by a brake cylinder or other actuator, so that the total normal force on all the brake shoes is considerably larger than the force provided by the actuator.

It is a further object of the present invention to provide a braking system in which brake shoes are applied both to wheel treads and to discs attached to the wheel-axle assemblies, to maximize the heat that can be absorbed and communicated to the environment.

It is an additional object of the present invention to provide a design for a brake disc and brake shoe in which oblique braking surfaces are used, so that the total of the normal force on the brakepads exceeds the force applied to the brake shoe and, in which, wear of the disc and shoe does not reduce the total normal force.

It is yet another object of the present invention to provide an arrangement in which brake shoes are applied to the rim portions of the brake discs, to maximize the radius at which the retarding force of the brake shoes are applied.

It is a further object of the present invention to provide a lever arrangement for applying either equal or proportional forces to the brake shoes applied to the wheel treads and the brake shoes applied to the discs.

An additional object of the present invention is to provide a lever arrangement for distributing force between the brake shoes applied to the wheels and the brake shoes applied to the discs, in which the lever arrangement is offset to avoid spacial interference with structures in the environment in which the system is used.

Still another object of the present invention is to provide an offset lever arrangement for distributing force between the wheel brakeshoes and the disc brakeshoes, so that the brake disc can be attached to the wheel, rather than to the axle.

In addition to the various objects and advantages of the present invention which have been generally described above, there will be various other objects and advantages of the invention that will become more readily apparent to those persons who are skilled in the relevant art from the following more detailed description of such invention, particularly, when such detailed description is taken in conjunction with the attached drawing figures and with the appended claims.

BRIEF DESCRIPTION OF THE PRESENTLY MOST PREFERRED

AND VARIOUS ALTERNATIVE EMBODIMENTS OF THE INVENTION

Figure 1:
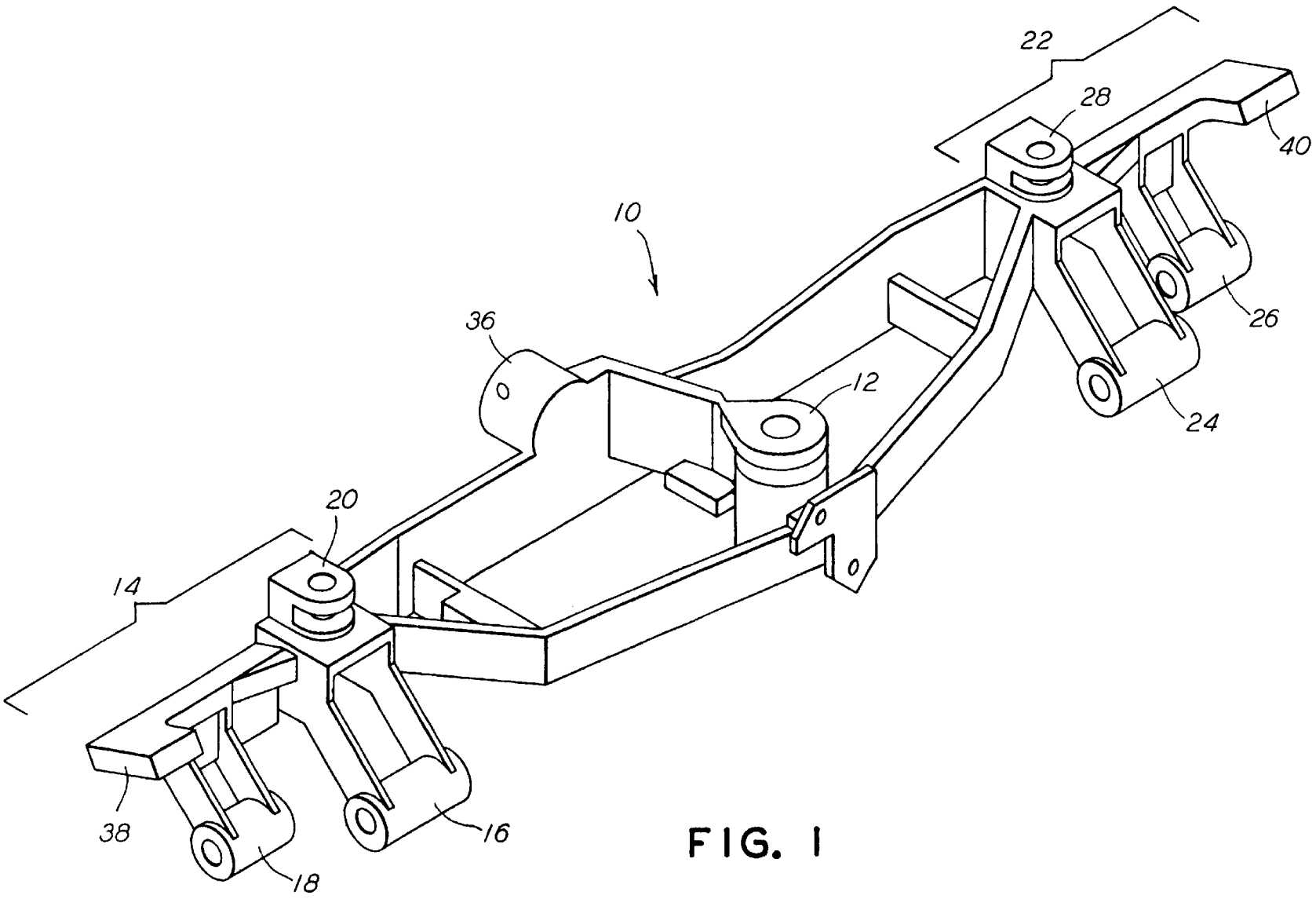
FIG. 1 is a perspective of a brakebeam for a railway vehicle braking system, the brakebeam having pivot connections according to the present invention.

Prior to proceeding to the much more detailed description of the present invention, it should be noted that identical components which have identical functions have been identified with identical reference numerals throughout the several views illustrated in the drawing Figures, for the sake of clarity and understanding of the invention.

FIG. 1 shows a perspective drawing of a brakebeam, generally denoted 10, for a railway vehicle braking system, according to a presently most preferred embodiment of the present invention.

Brakebeam 10 has a first pivot connection 12 and a first end portion 14. First end portion 14 has a first pivot connection 16, second pivot connection 18 and third pivot connection 20. Pivot connections 16 and 18 are for pivots having axes approximately parallel to brakebeam 10. Third pivot connection 20 is for a pivot having an axis approximately perpendicular to brakebeam 10. First end portion 14 has a wear plate 38 which rests on a structure (not shown) of the railway vehicle on which brakebeam 10 is mounted.

Brakebeam 10 has a second end portion 22. Second end portion 22 has a first pivot connection 24, second pivot connection 26 and third pivot connection 28. Pivot connections 24 and 26 are for pivots having axes approximately parallel to brakebeam 10. Third pivot connection 28 is for a pivot having an axis approximately perpendicular to brakebeam 10. Second end portion 22 has wear plate 40 where it rests on a structure (not shown) of the railway vehicle on which brakebeam 10 is mounted.

Figure 2:
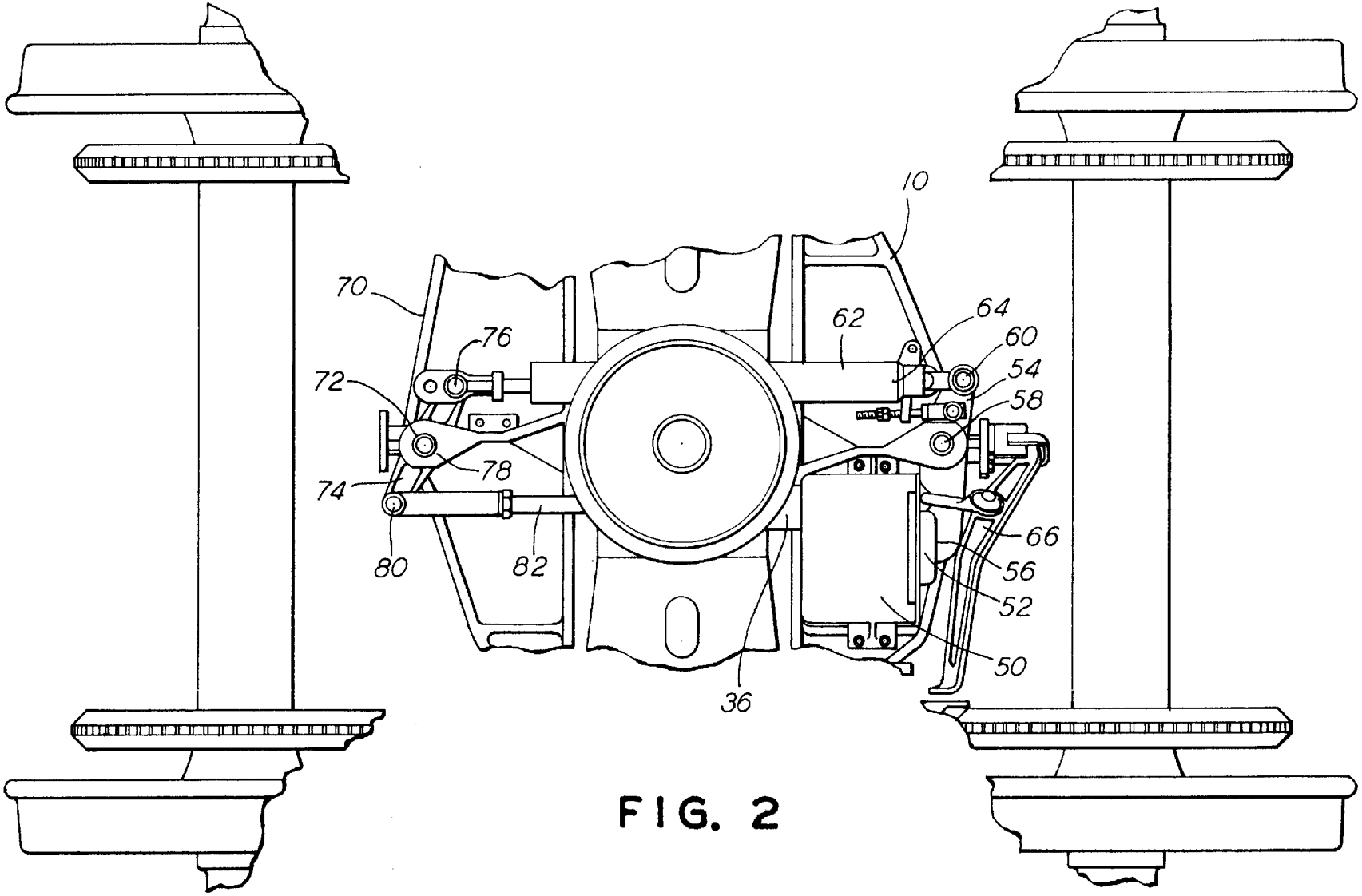
FIG. 2 is a plan view of a braking system for a railway vehicle according to the present invention, which includes the brakebeam shown in FIG. 1.

FIG. 2 is a plan view of a braking system for a railway vehicle according to the present invention, which includes the brakebeam 10 shown in FIG. 1. An actuator means having a first portion 50 and a second portion 52 is shown. In this presently most preferred embodiment, this is a pneumatic brake cylinder.

An actuator means lever 54 is connected to actuator means second portion 52 at actuator means lever first pivot connection 56. An actuator means lever second pivot connection 58 is connected to first pivot connection 12 of brakebeam 10.

An actuator means lever third pivot connection 60 is connected to first reaction means 62. The length of first reaction means 62 may be adjusted by slack adjuster 64.

An emergency brake having emergency brake lever 66 is used to set brakebeam 10 and a second brakebeam 70 in position for brake application. Second brakebeam 70 has second brakebeam first pivot connection 72. Equalizer lever 74 has equalizer lever first pivot connection 76 pivotally connected to the first reaction means 62. An equalizer lever second pivot connection 78 is connected to second brakebeam first pivot connection 72. Equalizer lever 74 has an equalizer lever third pivot connection 80 pivotally connected to second reaction means 82, which in this presently most preferred embodiment of the invention is a reaction rod. Second reaction means 82 is attached to brakebeam 10 at connection means 36.

Figures 3A, 3B:
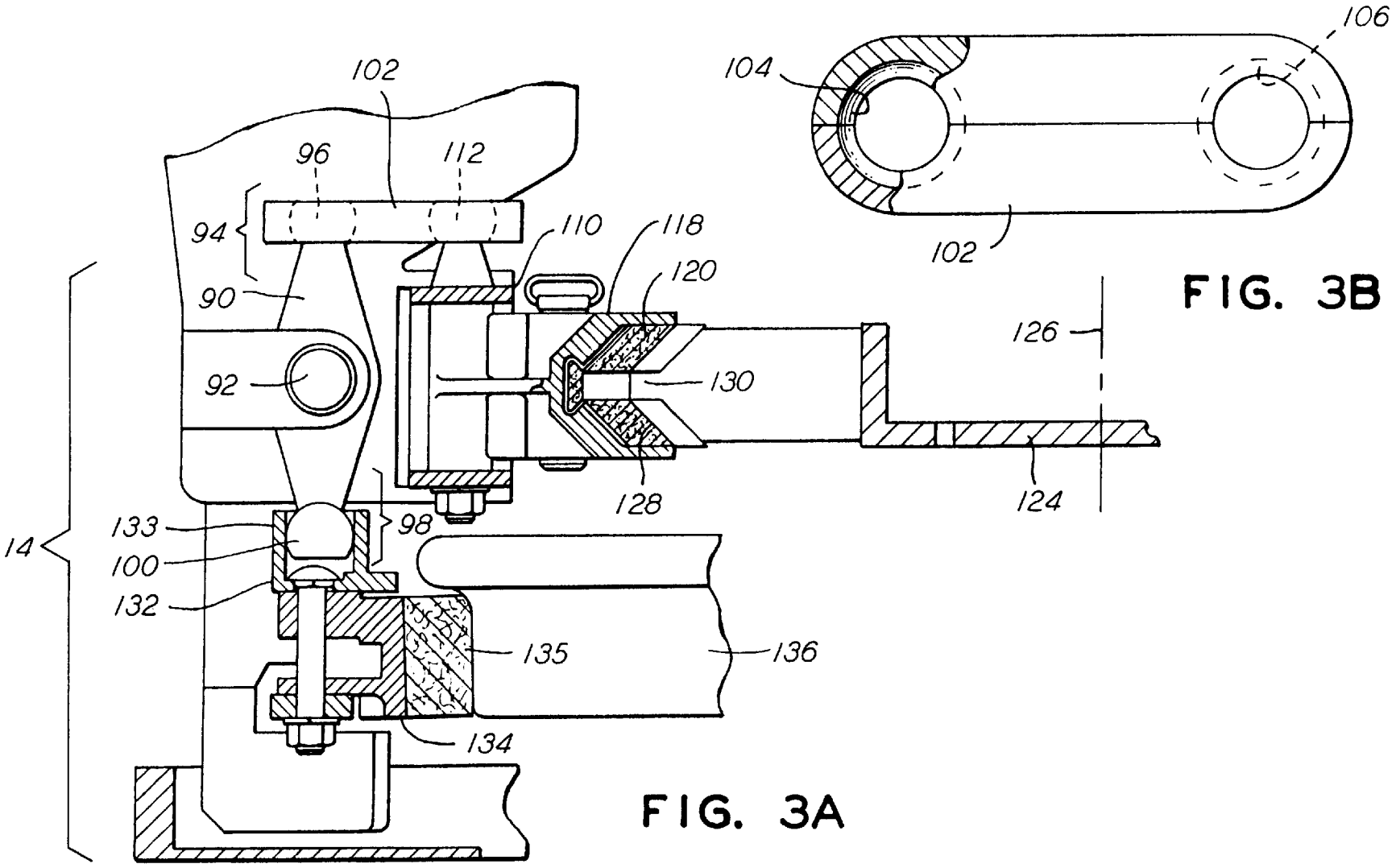
FIG. 3A is a plan view of an end portion of a brakebeam, showing brakehangers for tread and disc brake shoes in greater detail.
FIG. 3B is an enlarged view of the link illustrated in FIG. 3A.

FIG. 3A shows a detail of end portion 14 of brakebeam 10 and includes attached brake heads and pads. A proportionalization lever 90 is pivotally connected at proportionalization lever pivot connection 92 to third pivot connection 20 of first end portion 14 of brakebeam 10 (Shown in FIG. 1).

Proportionalization lever 90 has first force delivery means 96 at its first end portion 94 and a second force delivery means 100 at its second end portion 98.

FIG. 3B shows link 102 having force receiving means 104 connected to first force delivery means 96 of proportionalization lever 90. FIG. 4A shows a top view of disc brake hanger 110 to which link 102 is connected.

In the embodiment shown, first force delivery means 96 is a protuberance having a part spherical surface formed on first end portion 94 of proportionalization lever 90 and force receiving means 104 is a hole or socket formed in link 102.

Link 102 has force delivery means 106 connected to disc brake hanger 110 at disc brake hanger force receiving means 112. In the embodiment shown, disc brake hanger force receiving means 112 is formed as a protuberance having a part spherical surface and link force delivery means 106 is formed as a hole or socket into which disc brake hanger force receiving means 112 fits.

Figure 4C:
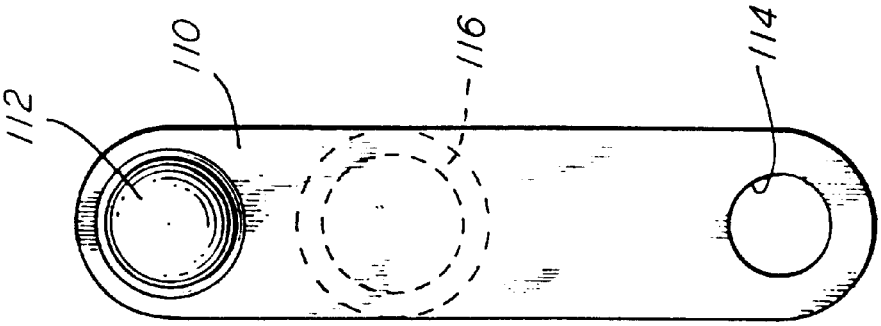
FIG. 4C is a view of the brake hanger for the disc brake shoe, which is taken looking parallel to the long dimension of the brakebeam.
Figure 4B:
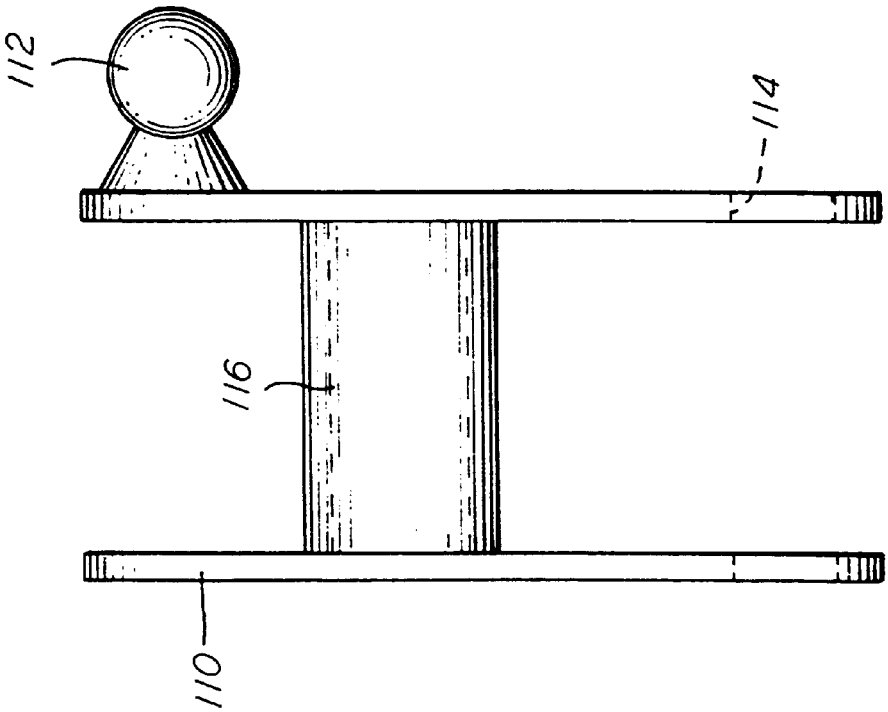
FIG. 4B shows a view of the brake hanger for the disc brake shoe, which is taken looking transversely to the long dimension of the brakebeam.
Figure 4A:
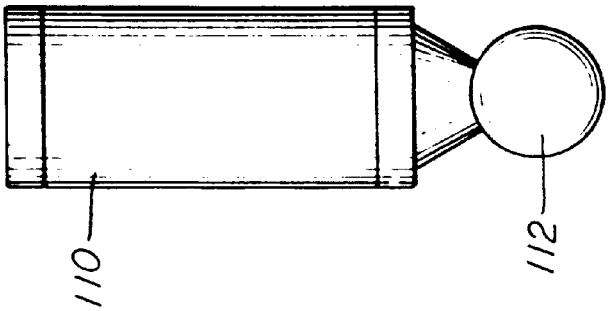
FIG. 4A shows a top view of a brake hanger for a disc brake shoe.

FIG. 4B shows a view of disc brake hanger 110 viewed perpendicular to brakebeam 10, when they are assembled, and FIG. 4C is a view of disc brake hanger 110 viewed parallel to brakebeam 10 when they are assembled.

Disc brake hanger 110 is pivotally connected to first pivot connection 16 of first end portion 14 of brakebeam 10 at disc brake hanger first pivot connection 114. Disc brake hanger 110 has disc brake hanger second pivot connection 116.

Disc brake shoe 118 is connected to disc brake hanger 110 at disc brake hanger second pivot connection 116. Disc brake shoe pad 120 is mounted on disc brake shoe 118.

FIG. 3A shows a brake disc 124 having axis 126. Brake shoe pad 120 is pressed against brake disc 124 to retard brake disc 124. Brake shoe pad 120 is pressed against brake disc 124 at disc friction surfaces 128. An air passage 130 is provided in brake disc 124 for cooling brake disc 124.

Figure 5D:
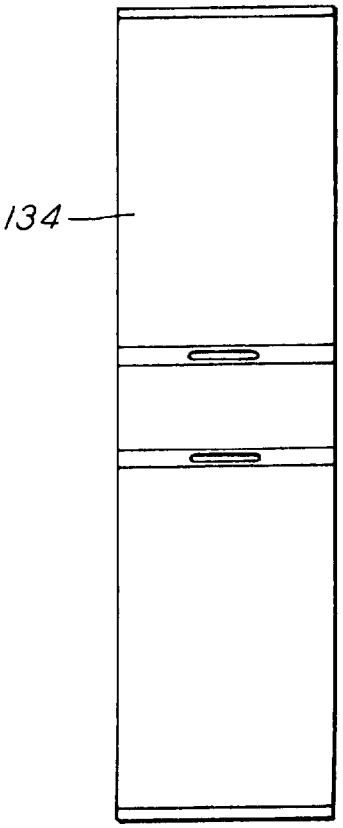
FIG. 5D shows a front view of the tread brake shoe.
Figure 5C:
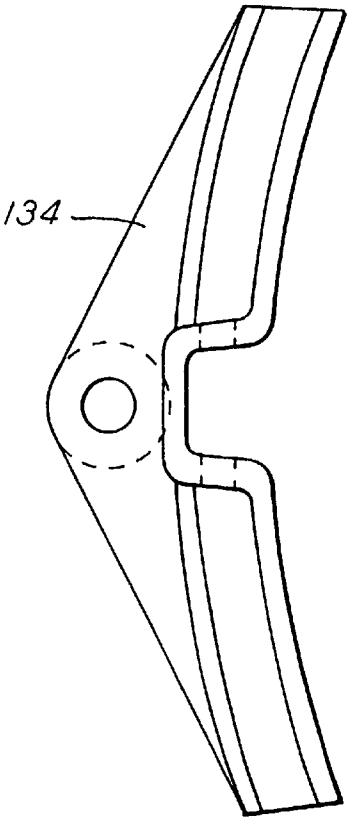
FIG. 5C shows a side view of the tread brake shoe.
Figure 5B:
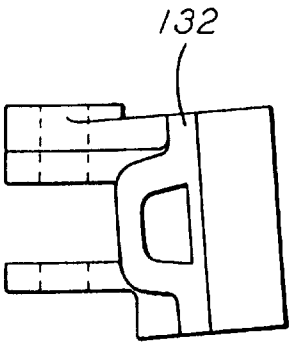
FIG. 5B is a top view of the tread brake shoe.
Figure 5A:
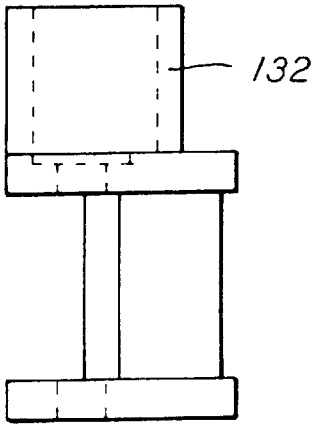
FIG. 5A shows a top view of the tread brake hanger.

FIG. 3A and FIGS. 5A and 5B show tread brake hanger 132, which is pivotally connected to brakebeam 10 at an end portion at second pivot connection 18. Tread brake hanger 132 has force receiving means 133. In the embodiment shown, force receiving means 133 is a socket for enclosing second force delivery means 100 of proportionalization lever 90. Tread brake shoe 134 is attached to tread brake hanger 132. Tread brake shoe pad 135 is attached to tread brake shoe 134 and is applied to railway vehicle wheel 136 to retard wheel 136. Wheel 136 has a common centerline with centerline 126 of brake disc 124.

Figure 6:
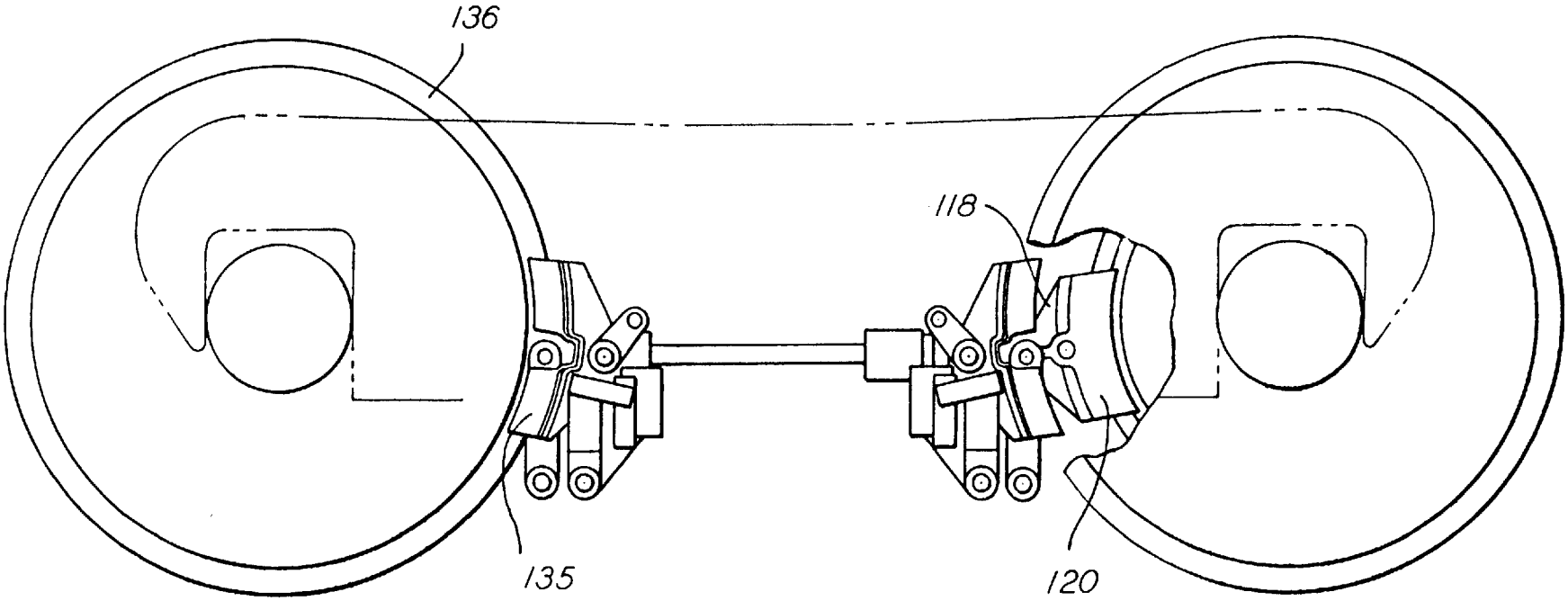
FIG. 6 shows an axial view of the braking system of the present invention-applied to two axles of a railway vehicle.

FIG. 6 shows the system viewed parallel to axis 126 of brake disc 124 and wheel 136. This figure shows tread brake shoe pad 135, disc brake shoe 118, disc brake shoe pad 120 and wheel 136.

The system described above operates with a flow of forces as follows: Actuator means second portion 52 exerts an actuator force on first pivot connection 56 of actuator means lever 54. Actuator means lever 54 exerts a delivered force at its second pivot connection 58, which serves as a fulcrum, and a reaction force on first reaction means 62 at its third pivot connection 60. The delivered force is applied to brakebeam 10 at its first pivot connection 12. The delivered force at actuator means lever second pivot connection 58 equals the sum of the actuator force applied to the actuator means lever its first pivot connection 56 plus the reaction force exerted at its third pivot connection 60. This feature is desirable to make the best use of the actuator force, by providing for amplification of the actuator force. The force delivered to the brakebeam is greater than the actuator force. In the presently most preferred embodiment, measuring along the actuator means lever, the distance between first pivot connection 56 and second pivot connection 58 is greater than the distance between second pivot connection 58 and third pivot connection 60. Because of a balance of moments about second pivot connection 58 (the fulcrum), the reaction force exceeds the actuator force. For the embodiment shown, the reaction force is about 1.6 times as great as the actuator force and the delivered force is about 2.6 times as great as the actuator force.

The reaction force is carried by first reaction means 62 to first pivot connection 76 of equalizer lever 74. Equalizer lever second pivot connection 78 serves as a fulcrum and provides a second delivered force to second brakebeam 70 at second brakebeam first pivot connection 72. Balance of moments requires a second reaction force which is communicated by equalizer lever third pivot connection 80, with the second reaction force equal to the first reaction force. The second delivered force is twice as great as either reaction force and is as great as the first delivered force applied to first brakebeam 10.

Second reaction means 82 delivers its second reaction force to the connection means 36, which is either attached to first brakebeam 10 or to first actuator means portion 50.

Now, discussing the invention more broadly, a brake system is described for retarding rotating machinery. It has an actuator such as a pneumatic or other fluid-filled cylinder which has a first portion (the cylinder itself) and a second relatively moveable portion, for example, the piston. The actuator is connected to an energization means, such as, a supply of pressurized fluid or compressed air. When it is energized, the actuator exerts a relative force between the first portion and the second portion to cause a relative motion of the first and second portion.

The system has an actuator means lever having three pivot connections. It has a first pivot connection to which the second portion of the actuator means is attached to receive the actuator force from the actuator means.

The system has a pair of brakebeams, the first brakebeam having a first pivot connection pivotally connected to the second pivot connection of the actuator means lever to receive a first brakebeam force from the actuator means lever. The first portion of the actuator means may be connected to the first brakebeam.

The system also has a first reaction means pivotally connected to the third pivot connection of the actuator means lever to receive a first reaction force from the actuator means lever.

The system also has an equalizer lever having three pivot connections. The first of the three pivot connections of the equalizer lever is pivotally connected to the first reaction means to receive the first reaction force from the first reaction means. The second pivot connection of the equalizer lever is pivotally connected to a first pivot connection on the second brakebeam to provide a second brakebeam force to the second brakebeam.

The system has a second reaction means pivotally connected to the third pivot connection of the equalizer lever to receive a second reaction force from the equalizer lever. The second reaction force is communicated to a second reaction means, which is connected in turn to either the first breakbeam or the first portion of the actuator, to provide a completed force balance.

Each brakebeam has a first end portion and a second end portion, the first end portion and the second end portion each having at least three pivot connections. The first pivot connection at either end is for a pivot having an axis approximately parallel to a longitudinal axis of the brakebeam. The second pivot connection also is for a pivot having an axis approximately parallel to a longitudinal axis of the brakebeam. Each end portion also has a third pivot connection which is for a pivot having an axis approximately perpendicular to the longitudinal axis of the brakebeam.

Each of the end portions of each of the brakebeams has a proportionalization lever which has a pivot connection, which may be at its center. The pivot connection is pivotally connected to the third pivot connection of the brakebeam end portion to receive force from the brakebeam. The proportionalization lever has force delivery means at each end.

For each of the end portions of each of the brakebeams, a first brake hanger is pivotally connected to the first pivot connection for pivotal rotation about the axis of the first pivot connection, which is approximately parallel to the major dimension of the brakebeam. The first brake hanger is positioned by and receives force from a force delivery means at the first end of the proportionalization lever.

A first brake shoe is attached to the first brake hanger, the first brake shoe to be forcefully applied to the rotating machinery.

Each end of the brakebeams also has a second brake hanger pivotally connected to the second pivot connection of the end portion of the brakebeam for pivotal rotation about the axis of the second pivot connection, which is approximately parallel to the major dimension of the brakebeam. The second brake hanger receives force from the second force delivery means of the proportionalization lever.

A second brake shoe is attached to the second brake hanger to be forcefully applied to the rotating machinery to retard the rotating machinery.

The rotating machinery may include one or more wheels mounted on an axle. It may also have one or more brake discs attached coaxially to the rotating machinery. The brake discs may be attached to wheels connected to an axle of the rotating machinery, or may be attached directly to the axle.

A brakebeam according to this invention may be placed so that its ends are adjacent wheels or discs of the rotating machinery so the brakeshoes can be applied to the wheels or discs. A brake shoe applied to a disc may be applied to a rim portion of a disc. The rim portion of a disc may have axisymmetric friction surfaces, and these may be sloped in opposition to each other, at an oblique angle relative to a radius of the disc. An opening for air flow may be provided between a pair of friction surfaces for cooling the disc. The pair of friction surfaces may be formed as a circumferential ridge with an opening along its apex. One or more air passages may be connected to the opening and the air passages may provide for radial airflow. The brake shoe may have one or more brakepads which are applied to the axisymmetric friction surfaces of the disc. The brakepads may be formed as, or positioned to form, a groove, which fits over the ridge of the brake disc. The groove may have bottom and central portions removed.

The rotating machinery to which this invention is applied may be a wheel and axle assembly for a railway vehicle. One or more of the brake shoes may be applied to the tread of the wheel.

The two brakebeams used in this invention may be located on opposite sides of a bolster of a railway vehicle on which the invention is used. Either of the reaction means of this invention may be in the form of a rod and one or more of these may pass through an opening in a bolster of the railway vehicle.

One or more of the reaction means may have a length which can be adjusted by a slack adjuster. The system may also have an emergency brake which is connected so that it can force the brake pads against the rotating machinery to prevent rotation of the rotating machinery.

While a presently preferred and various additional alternative embodiments of the instant invention have been described in detail above in accordance the patent statutes, it should be recognized that various other modifications and adaptations of the invention may be made by those persons who are skilled in the relevant art without departing from either the spirit or the scope of the appended claims.

I claim:

1. A brake system for retarding at least one rotating member, said brake system comprising:

(a) an actuator means having a first portion and a second portion, said first portion and said second portion having a degree of freedom for a relative motion, said actuator means providing a relative force between said first portion and said second portion, said relative force for causing said relative motion, said actuator means having means for connection to an energization means, such energization means for supplying energy to said actuator means;

(b) an actuator means lever having three pivot connections, a first of said three pivot connections pivotally connected to said second portion of said actuator means, said first of said three pivot connections for receiving an actuator force from said actuator means;

(c) a pair of brakebeams, a first one of said pair of brakebeams having a first pivot connection pivotally connected to a second one of said three pivot connections of said actuator means lever to receive a first brakebeam force from said actuator means lever, said first portion of said actuator means connected to said first one of said pair of brakebeams;

(d) a first reaction means pivotally connected to a third one of said three pivot connections of said actuator means lever to receive a first reaction force from said actuator means lever;

(e) an equalizer lever having three pivot connections, a first of said three pivot connections of said equalizer lever pivotally connected to said first reaction means to receive said first reaction force from said first reaction means, a second of said three pivot connections of said equalizer lever pivotally connected to a first pivot connection on a second one of said pair of brakebeams to provide a second brakebeam force to said second one of said pair of brakebeams;

(f) a second reaction means pivotally connected to a third one of said three pivot connections of said equalizer lever to receive a second reaction force from said equalizer lever, said second reaction means connected to at least one of said first brakebeam and said first portion of said actuator means;

(g) each of said pair of brakebeams having a first end portion and a second end portion, said first end portion and said second end portion each having at least three pivot connections, a first pivot connection for a pivot having an axis about parallel to a longitudinal axis of the brakebeam, a second pivot connection for a pivot having an axis about parallel to a longitudinal axis of the brakebeam and a third pivot connection for a pivot having an axis about perpendicular to a longitudinal axis of the brakebeam;

(h) for each of said end portions of each of said brakebeams, a proportionalization lever having a proportionalization lever pivot connection, said proportionalization lever pivot connection pivotally connected to said third pivot connection of said end portion of said brakebeam for receiving a first force from said brakebeam, said proportionalization lever having a first force delivery means at a first end of said proportionalization lever and a second force delivery means at a second end of said proportionalization lever;

(i) for each of said end portions of each of said brakebeams, a first brake hanger pivotally connected to said first pivot connection of said end portion of said brakebeam for pivotal rotation about an axis of said first pivot connection, said first brake hanger having a first means for receiving force from said first force delivery means of said proportionalization lever;

(j) a first brake shoe attached to said first brake hanger, said first brake shoe for forceful application to at least one rotating member to retard such at least one rotating member;

(k) for each of said end portions of each of said brakebeams, a second brake hanger pivotally connected to said second pivot connection of said end portion of said brakebeam for pivotal rotation about an axis of said second pivot connection, said second brake hanger having a second means for receiving force from said second force delivery means of said proportionalization lever; and (l) a second brake shoe attached to said second brake hanger, said second brake shoe for forceful application to such at least one rotating member to retard such at least one rotating member.

2. A brake system according to claim 1 herein said actuator means includes a cylinder and a piston, said piston driven by a fluid disposed within said cylinder, a pressure of such fluid controlled by such energization means.

3. A brake system according to claim 2 wherein said cylinder is a pneumatic cylinder and such fluid is compressed air.

4. A brake system according to claim 1 wherein such at least one rotating member includes two wheels mounted on an axle, said brake system including a first disc attached coaxially to such rotating member adjacent a first of such two wheels and a second disc attached coaxially to such rotating member adjacent a second of such two wheels, at least one of said pair of brakebeams disposed so that such first wheel and said first disc are adjacent a first end of said at least one of said pair of brakebeams and such second wheel and said second disc are adjacent a second end of said at least one of said pair of brakebeams.

5. A brake system according to claim 4 wherein for each of said end portions of at least one of said pair of brakebeams, said second brake shoe is applied to an adjacent one of such two wheels.

6. A brake system according to claim 4 wherein for each of said end portions of said pair of brakebeams, said first brake shoe is applied to an adjacent one of said two discs.

7. A brake system according to claim 6 wherein for each of said end portions of at least one of said pair of brakebeams, said first brake shoe is applied to a rim portion of said adjacent one of said two discs.

8. A brake system according to claim 7 wherein said rim portion of each of said two discs has a pair of axisymmetric friction surfaces sloped in opposition to each other with an opening therebetween.

9. A brake system according to claim 8 wherein for each of said two discs, said pair of axisymmetric friction surfaces are formed as a circumferential ridge with an opening along its apex.

10. A brake system according to claim 9 wherein each of said two discs has at least one air passage connected to said opening.

11. A brake system according to claim 10 wherein for each of said two discs, said at least one air passage provides for radial air flow for cooling said disc.

12. A brake system according to claim 9 wherein for each of said end portions of said pair of brakebeams, said first brake shoe is applied to said pair of axisymmetric friction surfaces.

13. A brake system according to claim 12 wherein for each of said end portions of at least one of said pair of brakebeams, said first brake shoe has a pair of brakepads formed as a groove with bottom and central portions missing, said brakepads for forcible application to said pair of axisymmetric friction surfaces.

14. A brake system according to claim 4 wherein such rotating member is a wheel and axle assembly for a railway vehicle.

15. A brake system according to claim 14 wherein said second brake shoe is applied to a tread of such wheel.

16. A brake system according to claim 14 wherein said first brakebeam and said second brakebeam are disposed on opposite sides of a bolster of such railway vehicle.

17. A brake system according to claim 16 wherein at least one of said reaction means is a reaction rod.

18. A brake system according to claim 17 wherein said reaction rod passes through an opening in said bolster.

19. A brake system according to claim 1 wherein at least one of said reaction means includes a slack adjuster means, said slack adjuster means for adjusting an effective length of said reaction means.

20. A brake system according to claim 1 further including an emergency brake, said emergency brake connected to forcefully engage said at least one of said first brake shoe and said second brake shoe with such rotating member to prevent rotation of such rotating member.

* * * * *